US007527507B2

(12) United States Patent
Liao et al.

(10) Patent No.: US 7,527,507 B2
(45) Date of Patent: May 5, 2009

(54) ELECTRICAL CONNECTOR ASSEMBLY WITH IMPROVED PICK UP CAP

(75) Inventors: Fang-Jun Liao, Tu-Cheng (TW); Chun-Yi Chang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/005,332

(22) Filed: Dec. 26, 2007

(65) Prior Publication Data

US 2008/0153355 A1 Jun. 26, 2008

(30) Foreign Application Priority Data

Dec. 26, 2006 (CN) ..... 2006 2 0152306

(51) Int. Cl.
*H01R 13/44* (2006.01)

(52) U.S. Cl. ..... 439/135

(58) Field of Classification Search ..... 439/135, 439/940, 892, 149; 206/724, 701
See application file for complete search history.

(56) References Cited

U.S. PATENT DOCUMENTS

| | | | | |
|---|---|---|---|---|
| 4,217,024 | A * | 8/1980 | Aldridge et al. | 439/381 |
| 5,073,118 | A * | 12/1991 | Grabbe et al. | 439/71 |
| 5,277,601 | A * | 1/1994 | Miyazawa | 439/135 |
| 6,875,022 | B2 | 4/2005 | Ma | |
| 6,905,353 | B2 | 6/2005 | Ma et al. | |
| 2007/0139904 | A1 * | 6/2007 | English et al. | 361/818 |

* cited by examiner

*Primary Examiner*—Phuong K Dinh
(74) *Attorney, Agent, or Firm*—Wei Te Chung

(57) ABSTRACT

An electrical connector assembly (1) includes an electrical connector including an insulative housing (2) having opposite upper and lower surfaces, and a number of contacts received in the insulative housing and partially exposed beyond said upper and lower surfaces of the insulative housing to form upper and lower exposed sections, an upper cover (3) assembled to the upper surface of the insulative housing, and a lower cover (4) assembled to the lower surface of the insulative housing. The contacts are wholly received between the upper and lower covers without exposed outside.

11 Claims, 4 Drawing Sheets

3

ELECTRICAL CONNECTOR ASSEMBLY WITH IMPROVED PICK UP CAP

BACKGROUND OF THE INVENTION

1. Field of the Invention

The present invention generally relates to an electrical connector assembly, and more particularly to an electrical connector assembly for removably mounting a chip module, such as a Central Processing Unit (CPU), to a printed circuit board.

2. Description of Related Art

U.S. Pat. No. 6,875,022, issued on Apr. 5, 2005 and U.S. Pat. No. 6,905,353, both assigned to HonHai, disclose an electrical connector assembly for electrically connecting a chip module to a printed circuit board. The electrical connector assembly comprises an insulative housing, a plurality of contacts received in the insulative housing, and a pick-up cap covering an upper surface of the insulative housing. The insulative housing defines a plurality of contact-receiving slots penetrating through upper and lower surfaces thereof. The contacts are received in the contact-receiving slots and have upper and lower contacting surfaces. The insulative housing is displaced on the printed circuit board to form electrical connection between the lower contacting surfaces of the contacts with the printed circuit board. Then the chip module is placed on the upper surface of the insulative to form electrical connection with the upper contacting surfaces of the contacts. Thus, the electrical connection between the chip module and the printed circuit board is realized.

The pick-up cap is latchably assembled to the upper surface of the insulative housing. The pick-up cap can be absorbed by a vacuum mechanism to realize the movement of the electrical connector and covers the upper surface of the insulative housing to prevent dust from outside or damage made to upper contacting surfaces of the contacts. However, the electrical connector assembly with such structure has the shortcomings as follows: The pick-up cap only covers the upper surface of the insulative housing to protect the upper contacting surfaces of the contacts. The lower contacting surfaces of the contacts are not protected which are prone to be damaged or dusted during the movement of the insulative housing and the contacts.

Therefore, it is desired to provide an improved electrical connector assembly to stress the problems mentioned above.

BRIEF SUMMARY OF THE INVENTION

Accordingly, an object of the present invention is to provide an electrical connector assembly with improved structure for providing complete protection to contacts thereof.

In order to achieve the above-mentioned object, an electrical connector assembly in accordance with the present invention comprises an electrical connector comprising an insulative housing having opposite upper and lower surfaces, and a plurality of contacts received in the insulative housing and partially exposed beyond said upper and lower surfaces of the insulative housing to form upper and lower exposed sections, an upper cover assembled to the upper surface of the insulative housing, and a lower cover assembled to the lower surface of the insulative housing. The contacts are wholly received between the upper and lower covers without exposed outside.

Other objects, advantages and novel features of the invention will become more apparent from the following detailed description of the present embodiment when taken in conjunction with the accompanying drawings.

DETAILED DESCRIPTION OF THE INVENTION

Figure 1:
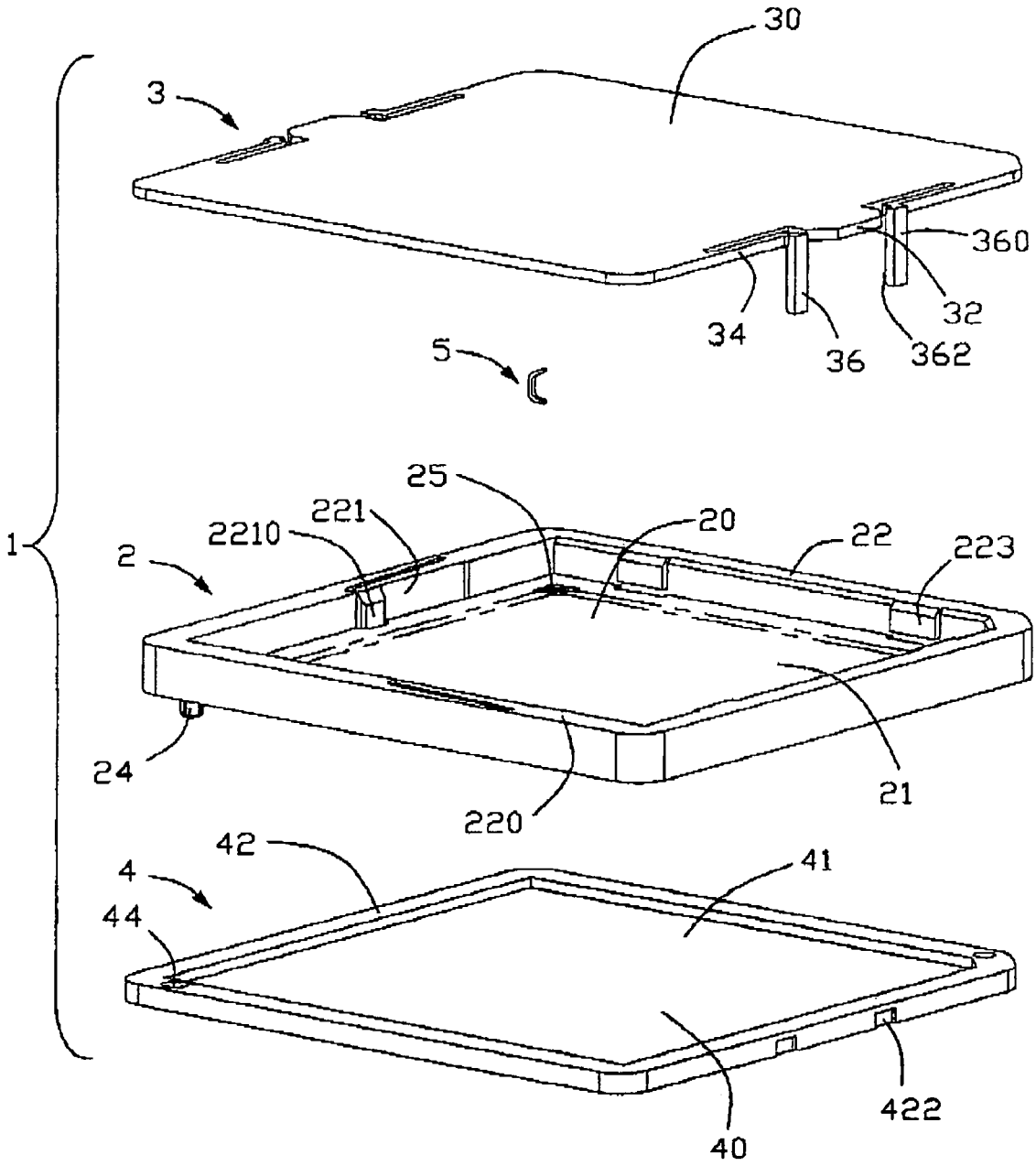
FIG. 1 is an exploded, perspective view of an electrical connector assembly in accordance with the preferred embodiment of the present invention.

Reference will now be made to the drawing figures to describe the present invention in detail.

Figure 2:
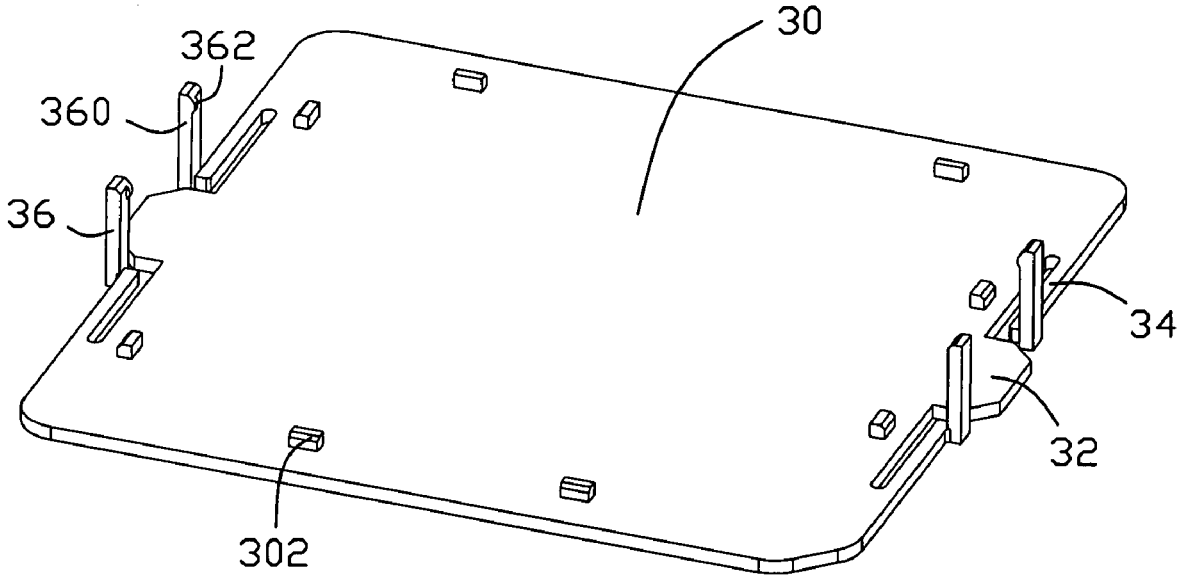
FIG. 2 is a bottom view of an upper cover shown in FIG. 1.
Figure 3:
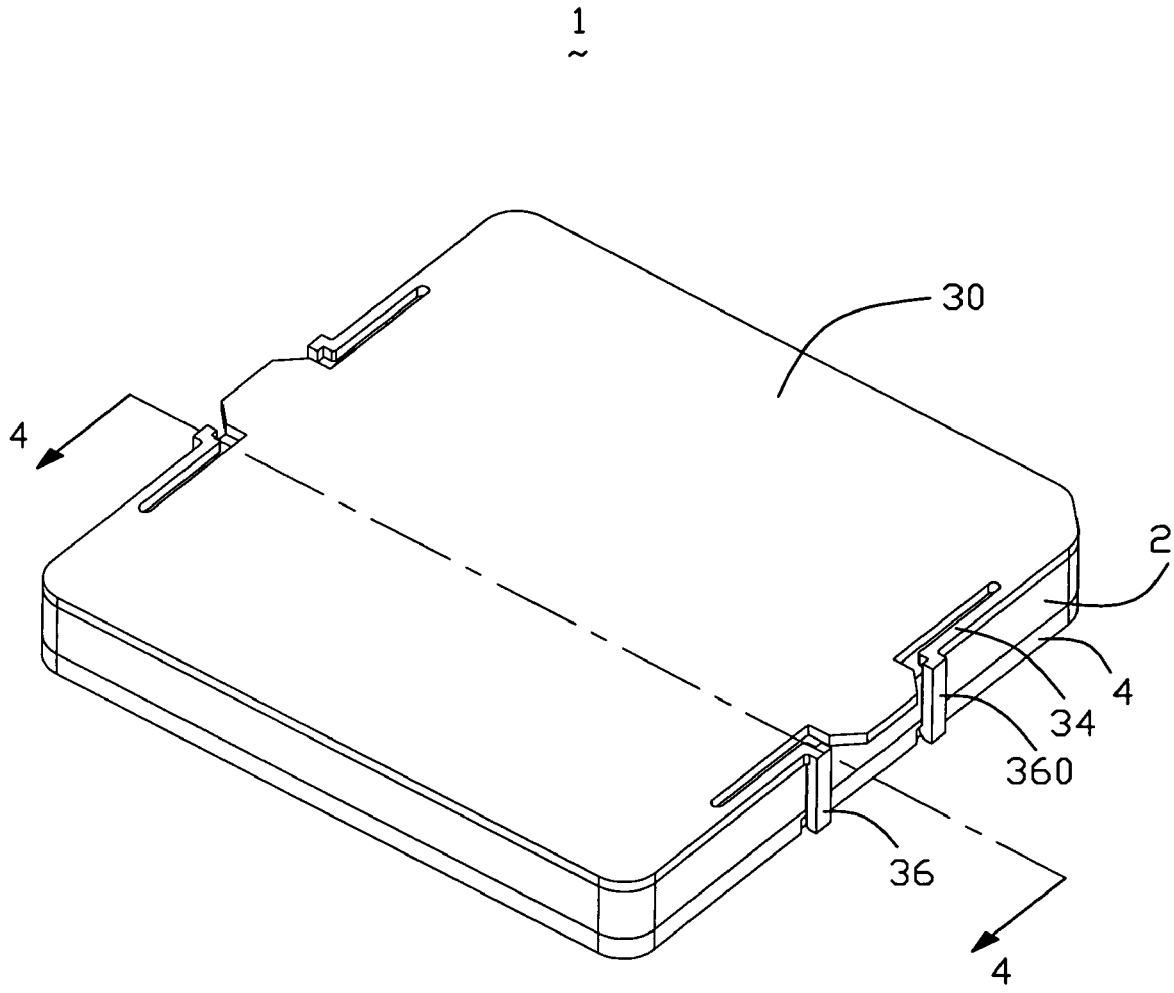
FIG. 3 is an assembled, perspective view of the electrical connector assembly of FIG. 1.
Figure 4:
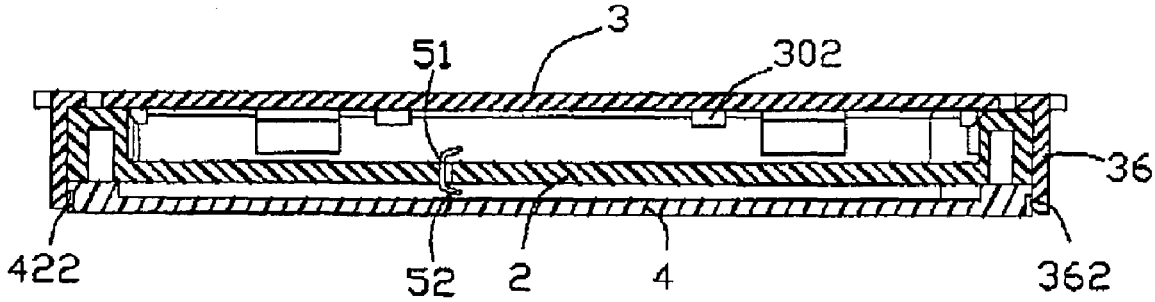
FIG. 4 is a cross-section view taken along line 4-4 of FIG. 3.

Please refer to FIGS. 1-4, an electrical connector assembly 1 in accordance with the preferred embodiment of the present invention is for electrically connecting a chip module (not shown), such as a Central Processing Unit (CPU), with a printed circuit board (PCB, not shown). The electrical connector assembly 1 comprises an insulative housing 2, a plurality of contacts 5 accommodated in the insulative housing 2, an upper cover 3 covering upper surfaces of the insulative housing 2 and the contacts 5, and a lower cover 4 covering lower surfaces of the insulative housing 2 and the contacts 5.

The insulative housing 2 is substantially rectangular and comprises a main portion 21 and four sidewalls 22 extending upwardly from the main portion 21. A receiving space 20 is circumscribed by the main potion 21 and the sidewalls 22 for accommodating the chip module. A plurality of contact-receiving passages 25 are defined through upper and lower surfaces of the main portion 21 to receive the contacts 5 therein. Two adjacent sidewalls 22 form a pair of spring arms 221 splitting therefrom facing the receiving space 20. Each spring arm 221 forms a protrusion 2210 at a free end thereof to protrude into the receiving space 20 for elastically abutting against the chip module. The other two sidewalls 22 each forms a pair of projections 223 aligning with each other to serve as a datum for the chip module.

Each contact 5 comprises upper and lower contacting surfaces 51, 52 respectively exposed beyond upper and lower surfaces of the insulative housing 2. At least a pair of posts 24 depend downwardly from the lower surface of the insulative housing 2 for positioning the insulative housing 2 relative to the printed circuit board. The posts 24 can be parts of the insulative housing 2 and formed integrally with the insulative housing 2 separate members assembled to the insulative housing 2.

The upper cover 3 is a flat board and comprises a body portion 30 covering the upper surface, that is top surfaces 220 of the sidewalls 22 and a pair of detaching members 32 formed at opposite edges of the body portion 30. Two pairs of elastic arms 34 splitting the opposite edges of the body portion 30 are respectively located at opposite sides of each detaching member 32 and extend toward each other. A pair of latching sections 36 respectively extend downwardly from opposite free ends of each pair of elastic arms 34 with stretching arms 360 connecting with the elastic arms 34 and latches 362 formed at free ends of the stretching arms 360. A plurality of ribs 302 extends downwardly from bottom surface of the body portion 30 toward the insulative housing 2 for abutting against the insulative housing 2. The top surface of the body portion 30 is smooth and is capable of being absorbed by a vacuum mechanism to realize the movement of the insulative housing 2.

The lower cover 4 is substantially rectangular and comprises a base portion 41 and four lateral walls 42 extending upwardly a certain distance from the base portion 41. An opening 40 is formed by the base portion 41 and the lateral walls 42 to accommodating the lower contacting surfaces 52 of the contacts 5. At least a pair of through holes 44 are defined through the lateral walls 42 to accommodating the posts 24 of the insulative housing 2 to position the lower cover 4 relative to the insulative housing 2. Corresponding to the latches 362 of the latching sections 36, the lower cover 4 defines two pairs of recesses 422 spaced arranged on opposite lateral walls 42 and opening toward bottom surface thereof to form steps for being latched by the latches 362 to position the upper cover 3 relative to the lower cover 4. Thus, alter assembly, the insulative housing 2 with the contacts 5 are received between the upper and lower covers 3, 4 with the upper and lower contacting surfaces 51, 52 of the contacts 5 are all protected from being damaged or dusted. The upper and lower covers 3, 4 can be made from semitransparent material or transparent material, thus, the status of the upper and lower contacting surfaces 51, 52 of the contacts 5 can be inspected.

When mounted to the PCB, the upper and lower cover 3, 4 are detached so that the insulative housing 2 with contacts 5 can be secured to the PCB by the posts 24. At this time, the lower contacting surfaces 52 are connected with the PCB. Since the upper cover 3 is still positioned on the insulative housing 2 by the ribs 302, system manufacturer could take way the upper cover 3 or not according to different requirements.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an electrical connector, comprising:

an insulative housing having opposite upper and lower surfaces; and a plurality of contacts received in the insulative housing and partially exposed beyond said upper and lower surfaces of the insulative housing to form upper and lower exposed sections;

an upper cover assembled to the upper surface of the insulative housing; and a lower cover assembled to the lower surface of the insulative housing; and wherein the contacts are wholly received between the upper and lower covers without exposed outside;

wherein the insulative housing comprises a main portion and four sidewalls extending upwardly from the main portion, and wherein two sidewall form a pair of spring arms for elastically abutting against a chip module.

2. The electrical connector assembly as claimed in claim 1, wherein the upper and lower covers are latchably assembled with each other.

3. The electrical connector assembly as claimed in claim 2, wherein the upper cover forms at least a pair of latching sections extending from opposite edges thereof toward the lower cover, and wherein the lower cover defines at least a pair of recesses to latch wit the latching sections.

4. The electrical connector assembly as claimed in claim 3, wherein the upper cover forms a pair of detaching sections at said opposite edges thereof, and wherein the at least a pair of latching sections is two pairs of latching sections with each pair of latching sections locating at opposites of the detaching section.

5. The electrical connector assembly as claimed in claim 4, wherein the lower cover defines two pairs of recesses to receive the two pairs of latching sections.

6. The electrical connector assembly as claimed in claim 1, wherein the upper cover attaches to upper surfaces of the sidewalls to form a first close space with upper exposed sections of the contacts received in the first close space.

7. The electrical connector assembly as claimed in claim 6, wherein the lower cover comprises a base portion and four lateral walls extending upwardly from the base portion, and wherein the lateral walls contacts the lower surface of the insulative housing to form a second close space with lower exposed sections of the contacts received in the second close space.

8. The electrical connector assembly as claimed in claim 1, wherein each of the other two sidewalls form a pair of protrusions aligning with each other to serve as datum for the chip module.

9. An electrical connector assembly comprising:

an insulative housing having an upper surface and an opposite lower surface, the insulative housing comprising a main portion defining a plurality of contact-receiving passages therethrough and four sidewalls extending upwardly from the main portion, and wherein two sidewalls from a pair of spring arms for elastically abutting a chip module;

a plurality of contacts received in the insulative housing and partially exposed beyond the upper and lower surfaces; and first and second covers assembled to the upper and lower surfaces of the insulative housing to form a first and a second close spaces together with the insulative housing;

and wherein the contacts are partially received in the first and second close spaces.

10. The electrical connector assembly as claimed in claim 9, wherein each contact is partially exposed beyond the upper surface of the insulative housing to form an upper exposed section, wherein the upper exposed sections of the contacts are received in the first close space.

11. The electrical connector assembly as claimed in claim 10, wherein each contact is partially exposed beyond the lower surface of the insulative housing to form a lower exposed section, wherein the lower exposed sections of the contacts are received in the second close space.

* * * * *